United States Patent [19]

Akatsu et al.

[11] 4,096,462

[45] Jun. 20, 1978

[54] DEFLECTION YOKE DEVICE FOR USE IN COLOR TELEVISION RECEIVER SETS

[75] Inventors: Mitsuharu Akatsu; Ichiro Niitsu; Masao Obara; Ryoichi Hirota; Shuzo Matsumoto; Takesuke Maruyama, all of Yokohama, Japan

[73] Assignee: Hitachi, Ltd., Japan

[21] Appl. No.: 785,523

[22] Filed: Apr. 7, 1977

[30] Foreign Application Priority Data

Apr. 9, 1976 Japan ..... 51-39339

[51] Int. Cl.[2] ..... H01F 5/00

[52] U.S. Cl. ..... 335/213; 335/210

[58] Field of Search ..... 335/210, 213

[56] References Cited

U.S. PATENT DOCUMENTS 2,617,059 11/1952 Neeteson ..... 335/213 X 3,735,193 5/1973 Ikeuchi ..... 335/213 X 3,849,749 11/1974 Kadota ..... 335/213 X

*Primary Examiner*—George Harris

*Attorney, Agent, or Firm*—Craig & Antonelli

[57] ABSTRACT

The present invention relates to a deflection yoke device which is preferably combined with an in-line type color picture tube having electron guns aligned horizontally. The distribution of magnetic fields is determined in the horizontal direction such that a sharp or strong barrel magnetic field is localized on the side of the neck portion whereas an extremely sharp pincushion magnetic field is localized on the side of the funnel portion and at the same time, an intensely sharp pincushion magnetic field is distributed between the funnel portion and the neck portion. The central electron beam is deflected more at a greater angle than side electron beams so as to land outside the side electron beams.

1 Claim, 11 Drawing Figures

FIG.1
PRIOR ART
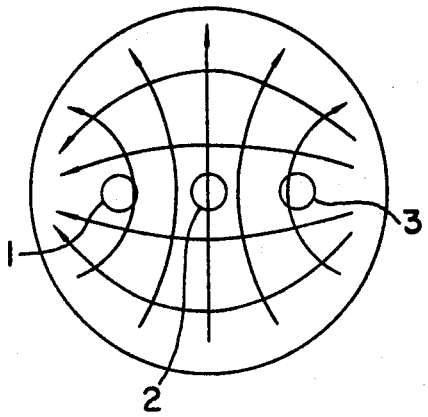
FIG.2
PRIOR ART
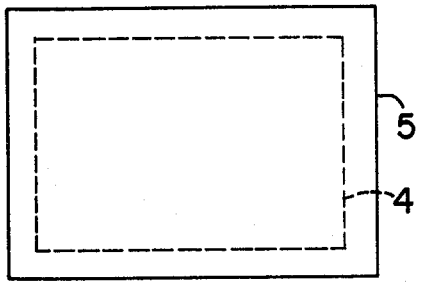
FIG.3
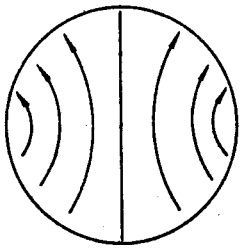
FIG.4
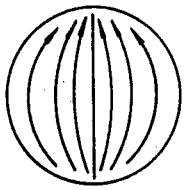
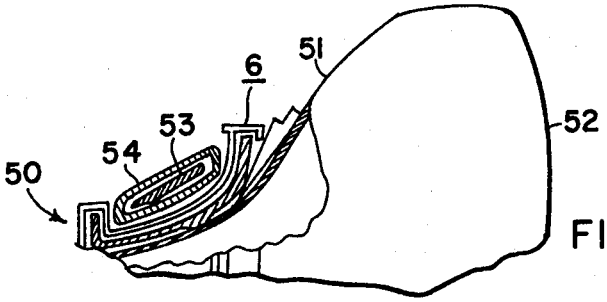
FIG.11

DEFLECTION YOKE DEVICE FOR USE IN COLOR TELEVISION RECEIVER SETS

The present invention relates to a deflection yoke device for deflecting electron beams in color picture tubes and more particularly to a deflection yoke device suitable for use in in-line type color picture tubes.

In the accompanying drawings:

FIG. 1 is a diagramatic representation showing deflection magnetic fields of a conventional 90° deflection in-line type color picture tube;

FIG. 2 is a diagramatic representation of a coma aberration due to the deflection magnetic fields of FIG. 1;

FIGS. 3 and 4 show magnetic distributions useful to explain a deflection yoke device according to the present invention;

FIG. 11 is a partial and sectional view of a yoke device of the present invention in conjunction with a picture tube.

Figure 5:
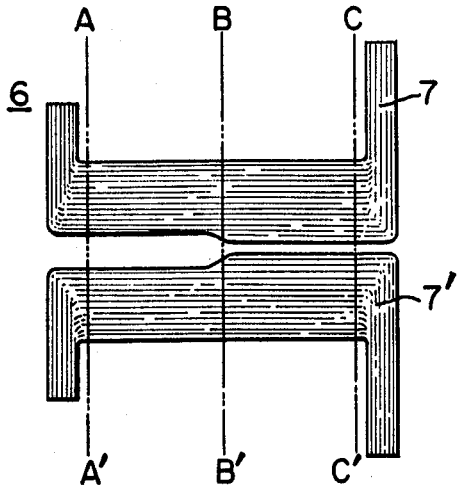
FIG. 5 is a schematic side view showing a horizontal deflection coil of the deflection yoke device according to the invention.

When a 90° in-line type color picture tube of a conventional type is combined with a deflection yoke device having a magnetic field distribution wherein, as shown in FIG. 1, the vertical deflection magnetic field takes the form of a barrel and the horizontal deflection magnetic field is of a pincushion, it is possible to make convergence of the side electron beams over the entirety of the picture screen without using any vertical pincushion distortion correcting circuit. In FIG. 1, there are illustrated a left side electron beam (blue or B) 1, a central electron beam (green or G) 2 and a right side electron beam (red or R) 3 viewing the electron gun assembly from the phosphor faceplate of color picture tube.

With the deflection magnetic field as shown in FIG. 1, however, the convergence is effected only for the side electron beams 1 and 3 and the central electron beam 2 fails to converge with the side electron beams 1 and 3 so that a coma aberration is caused wherein the central electron beam 2 lands inside of the side electron beams 1 and 3 which converge with each other as shown in FIG. 2, where numeral 4 represents a rectangular pattern due to the central electron beam 2 and numeral 5 represents a rectangular pattern due to the converged side electron beams 1 and 3. The displacement between the converged side electron beams 1 and 3 and the central electron beam 2 becomes greater toward the periphery of the picture screen. Such a coma aberration results from the fact that the central electron beam 2 has less deflection sensitivity to the magnetic field than that of the side electron beams 1 and 3 especially at the neck side portion of a deflection yoke mounted on a color picture tube. Namely, at the neck side portion of deflection yoke, the central electron beam 2, side electron beams 1 and 3 run in a laterally or horizontally spaced relationship and weakened vertical and horizontal deflection magnetic fields act on the central electron beam 2 as compared with the side electron beams 1 and 3, resulting in the coma aberration as shown in FIG. 2.

It will be appreciated that the further the deflection magnetic field is spaced from the central axis of the color picture tube, the more curved is the deflection magnetic field with the result that a pincushion deformation is created by a deflection magnetic field at the funnel side portion of the deflection yoke mounted on the color picture tube, but a vertical pincushion distortion will be corrected since the horizontal deflection magnetic field due to the horizontal deflection coil takes the form of a pincushion at the funnel side portion of the horizontal deflection coil.

In 90°-deflection in-line type color picture tubes, the same inventors as those of this invention have previously materialized a deflection yoke device capable of not only making the convergence of the side electron beams 1 and 3 but also being almost free from vertical pincushion distortion by maintaining the horizontal magnetic field of the horizontal deflection coil, as a whole (from the funnel side to the neck side), to be a pincushion magnetic field to such an extent as necessary for the convergence of the side electron beams 1 and 3 and at the same time varying the horizontal magnetic field distribution along the Z-axis (parallel to the electron beam running direction) such that the horizontal magnetic field is of a sharp or strong pincushion at the funnel side portion of the horizontal deflection coil whereas it is a weak pincushion at the neck side portion thereof. This is based on the fact that while the convergence characteristics are determined by the magnetic field distribution of the entirety of deflection yoke, distortions on the picture screen such as the pincushion distortion is created rather by the magnetic field at the funnel side portion.

In this manner, a deflection yoke device applicable to a 90° in-line type color picture tube has been obtained capable of making a complete convergence of the side electron beams 1 and 3 and being devoid of any vertical pincushion distortion on the picture screen. In a wide deflection angle color picture tube such as a 110° deflection type, for example, it was impossible to obtain a deflection yoke device which ensured the convergence of side electron beams 1 and 3 over the entire picture screen as well as to ensure the elimination of vertical pincushion distortion since coma aberration and pincushion distortion before correction are present to a large extent. In this connection, it should be understood that the dimension and magnetic field distribution of a deflection yoke device that can make the convergence of side electron beams 1 and 3 over the entirety of picture screen as well as the elimination of vertical pincushion distortion are determined dependent on the spacing between electron guns, deflection angle, picture screen size of a color picture tube in question, but heretofore quantitative relations between these factors were not made clear.

Accordingly, whenever a wide deflection angle color picture tube such as a 110° deflection type is combined with a deflection yoke device having the vertical deflection magnetic field of a barrel and the horizontal deflection magnetic field of a pincushion, there still remains vertical pincushion distortion. Further, where a deflection yoke device having a magnetic field in the form of a sharp pincushion at the funnel side portion of horizontal deflection coil is applied to the wide deflection angle color picture tube, the vertical pincushion distortion may be corrected on the one hand but, on the other hand, a coma aberration is caused wherein the side electron beams 1 and 3 are prevented from being converged both vertically and horizontally.

An object of the invention is to provide an improved deflection yoke device capable of eliminating the aforementioned drawbacks of the prior art device.

Another object of the invention is to provide a novel deflection yoke device dispensing with any dynamic convergence correcting circuit and vertical pincushion distortion correcting circuit when applied to wide deflection angle in-line type color picture tubes.

According to main feature of the present invention, the winding distribution of the entirety of a vertical deflection coil is formed to take a barrel magnetic field and the winding distribution of the entirety of a horizontal deflection coil is formed to take a pincushion magnetic field thereby to make the convergence of side electron beams over the entirety (vertical and horizontal) of a picture screen, and the magnetic field distribution of the horizontal deflection coil along the Z-axis is defined such that the winding distribution at the funnel side (on the faceplate side) produces a sharply localized pincushion magnetic field and the winding distribution at the neck side (on the electron gun assembly side) produces a localized barrel magnetic field which is sufficiently sharp to allow a central electron beam to land on the picture screen outside the side electron beams.

According to one aspect of the present invention there is provided a deflection yoke device comprising a core, a vertical deflection coil and a horizontal deflection coil, in combination with an in-line type color picture tube; said vertical deflection coil having a winding distribution for producing a barrel type magnetic field distribution and said horizontal deflection coil having a whole winding distribution for producing a pincushion type magnetic field distribution sufficient to converge side electron beams over the entirety of a picture screen of said color picture tube and further having a first winding distribution, at the funnel side portion of the horizontal deflection coil, for producing a sharp pincushion type magnetic field distribution as well as a second winding distribution, at the neck side portion of the horizontal deflection coil, for producing a sharp barrel type magnetic field sufficient to permit the central electron beam to land outside the side electron beams converged with each other at the right and left sides of the picture screen.

Through various experiments directed to reduce vertical pincushion distortions under a self-convergence system in a wide deflection angle color picture tube and a deflection yoke device in combination, the inventors of the present invention have found that it is necessary in the case of the wide deflection angle color picture tube not only to make a horizontal deflection magnetic field at the funnel side portion of the horizontal deflection coil a pincushion magnetic field of an extremely large magnitude but also to make the horizontal deflection magnetic field at the neck side portion a barrel magnetic field of a large magnitude, differing from the deflection yoke which has been conventionally available. The magnitude of this barrel magnetic field needs to be varied dependent on the spacing between electron guns, deflection angle and picture screen size and the larger the deflection angle, the greater the barrel magnetic field needs to be.

A wide deflection angle color picture tube such as 110° deflection type suffers from accelerated pincushion distortions and accordingly, in order to eliminate the vertical pincushion distortion correcting circuit, the horizontal deflection magnetic field is designed to be a more curved or intensified pincushion magnetic field as compared a 90° deflection type.

More particularly, a horizontal deflection magnetic field near the funnel side portion of a horizontal deflection coil is made more pincushion-like as shown in FIG. 3 thereby to effectively correct the vertical pincushion distortion. On the other hand, the pincushion magnetic field intensified near the funnel side portion of horizontal deflection coil would cause an excessive correction for the convergence between the side electron beams 1 and 3. Therefore, in order to cancel the excessive correction and to obtain a normal correction, a horizontal deflection magnetic field near the neck side portion of the horizontal deflection coil is made, in contrast to the pincushion type, a barrel type as shown in FIG. 4.

The horizontal magnetic field of a horizontal deflection coil including a large magnitude pincushion magnetic field at the funnel side portion and a large magnitude barrel magnetic field at the neck side portion ensures, even in case of the wide deflection angle color picture tube such as 110° deflection type, the elimination of a vertical pincushion distortion corresting circuit as well as the convergence of the side electron beams 1 and 3.

A deflection yoke device of the present invention is constructed as will be detailed hereunder. The deflection yoke device 50 according to the invention utilized in connection with a picture tube 51 having a screen 52 as shown in a partial sectional view in FIG. 11 comprises a core 53, a vertical deflection coil 54 having a toroidal coil wound around the core and a horizontal deflection coil 6 in the form of a barrel, but the vertical deflection coil is wound and formed in the same manner as a conventional one and produces a barrel type magnetic field distribution as a whole. Such a vertical deflection coil as mentioned just above is combined with a horizontal deflection coil having a construction as described in detail hereinafter for the specific purposes of the present invention as mentioned hereinbefore.

As shown in section in FIG. 5, a horizontal deflection coil 6 of the deflection yoke device according to the invention comprises a pair of horizontal coils 7 and 7' formed into a barrel configuration. The horizontal deflection coils 7 and 7' produces, as a whole, a pincushion magnetic field whose distribution is shown at curve 8 in FIG. 9 and at the same time, along the Z-axis, a barrel magnetic field localized at the neck side portion and an extremely sharp magnitude pincushion magnetic field localized at the funnel side portion as shown at curve 9 in the same figure.

Figure 6:
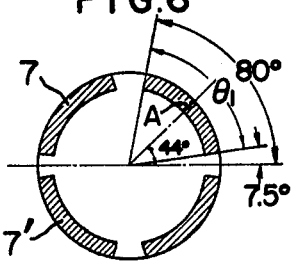
FIG. 6 is a sectional view taken on line A-A' in FIG. 5.
Figure 7:
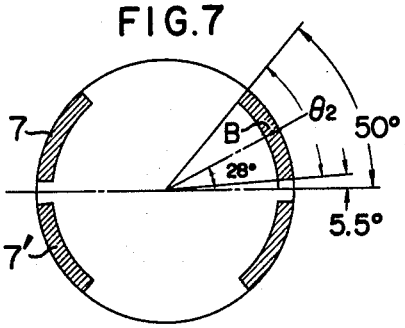
FIG. 7 is a sectional view taken on line B-B' in FIG. 5.
Figure 8:
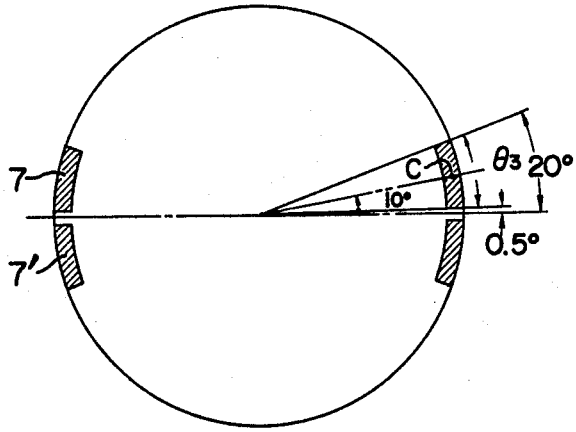
FIG. 8 is a sectional view taken on line C-C' in FIG. 5.

The horizontal deflection coils 7 and 7' have different winding distributions as shown in section in FIGS. 6, 7 and 8. More particularly, the horizontal deflection coils 7 and 7' of FIG. 5 each have, at a cross-section on line A-A' shown in FIG. 6, a winding distribution which has a coil winding width angle $\theta_1$ subtending (80–7.5) degrees and a center of gravity A at 44°; at a cross-section on line B-B' shown in FIG. 7, a winding distribution which has a coil winding width angle $\theta_2$ subtending (50–5.5) degrees and a center of gravity B at 28°; and at a cross section on line C-C′ shown in FIG. 8, a winding distribution which has a coil winding width angle $\theta_3$ subtending (20–0.5) degrees and a center of gravity C at 10°.

The most important factor of the winding distribution of horizontal deflection coils 7 and 7′ is an angle subtending for the center of gravity and depending on this angle, the magnetic field distribution is determined as either a pincushion type of a barrel type. That is to say, with an angle for the center of gravity of 30°, a substantially uniform magnetic field is produced; with an angle of less than 30°, a pincushion magnetic field is produced; and with this angle of more than 30°, a barrel magnetic field is produced.

Figure 9:
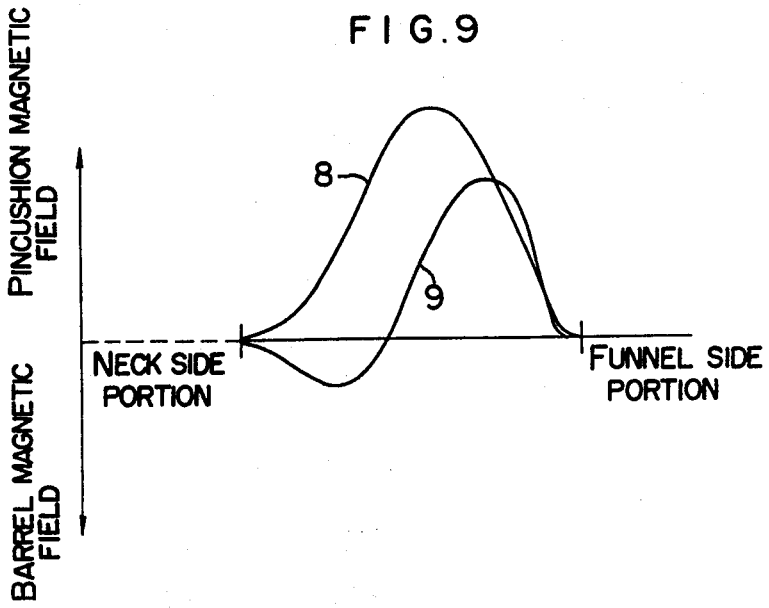
FIG. 9 is a graphic representation of magnetic field distribution along the Z-axis of a color picture tube obtainable from a deflection yoke device embodying the invention.

Thus, the horizontal deflection coils 7 and 7′ produce extremely sharp barrel magnetic fields at the neck side portion corresponding to A-A′ section of FIG. 6 at which the center of gravity A of the winding distribution coincides at 44°, uniform magnetic fields not showing of barrel or pincushion magnetic fields at the central portion corresponding to B-B′ section of FIG. 7 at which the center of gravity B of winding distribution coincides at 28°, and an extremely sharp pincushion magnetic field at the funnel side portion corresponding to C-C′ section of FIG. 8 at which the center of gravity C of winding distribution coincides at 10°. The magnetic field distribution of a variety of these types of field along the Z-axis is shown in FIG. 9.

As has been described, since, in the deflection yoke device according to this invention, the vertical deflection coil is of a barrel magnetic field, and the winding distribution of the horizontal deflection coil is of a pincushion magnetic field as a whole and, along the Z-axis, is of a barrel magnetic field at the neck side portion whereas of a sharp pincushion magnetic field at the funnel side portion, the deflection yoke device combined with the wide deflection angle color picture tube such as 110° deflection type permits a pattern wherein the convergence of side electrons beams 1 and 3 is ensured and vertical pincushion distortion is eliminated, while dispensing with the vertical pincushion distortion correcting circuit.

Figure 10:
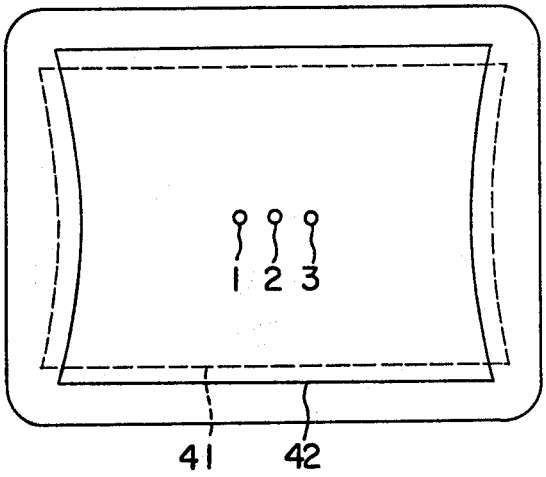
FIG. 10 is a diagramatic representation of rectangular patterns according to the invention.

In this manner, the horizontal deflection magnetic field which includes a sharp pincushion magnetic field at the funnel side portion and a sharp barrel magnetic field ensures, even when applied to a wide deflection angle color picture tube, the elimination of the vertical pincushion distortion correcting circuit as mentioned above as well as the convergence of side electron beams 1 and 3, thus giving rise to a coma aberration different from that of FIG. 2 such that the central electron beam 2 lands outside the side electron beams 1 and 3 as shown in FIG. 10. In FIG. 10 showing rectangular patterns according to the present invention, numeral 41 designates a rectangular pattern due to the central electron beam and 42 a rectangular pattern due to the converged side electron beams. To repeat, the rectangular pattern 41 indicative of the central electron beam is present outside the rectangular pattern 42 indicative of the side electron beams due to the fact that the horizontal deflection magnetic field taking the form of the barrel at the neck side portion has the greatest intensity at the central portion of the picture screen and is decreased in its intensity toward the periphery (in the horizontal direction) of the picture screen so that the central electron beam is deflected much more than the side electron beams.

With the deflection yoke device of the invention including the horizontal deflection coil of FIG. 5 with winding distributions shown in FIGS. 6, 7 and 8 mounted on a 22-inch 110° deflection in-line type color picture tube (spacing between electron guns being 6.6 m/m, 560 ALB 22 type, manufactured by Hitachi, Ltd.), the amount of vertical pincushion distortion was within 1% at the uppermost and lowermost sides of the picture screen, the side electron beams completely converged with each other at the right and left sides of the picture screen, and the central electron beam was present 2 m/m outside the converged side electron beams.

Additionally, it is possible to converge the three electron beams at the right and left sides of the picture screen by changing the configuration of a coma aberration correcting magnetic pole piece (field controller) which is mounted to a portion of the electron gun.

As has been described in the foregoing, the novel deflection yoke device with the magnetic field distribution which has not been realized heretobefore may be combined with the wide deflection angle in-line type color picture tube to permit the elimination of a very expensive correcting circuit for making the convergence of side electron beams over the entire picture screen and vertical pincushion distortion correcting circuit, thereby greatly contributing to reduction in the costs of color picture tubes. Further, the deflection yoke device of the invention dispenses with these correcting circuits which inherently suffer unstable performance due to a number of portions to be adjusted and there is no decrease in reliability due to the reduction in the number of circuit elements and it is highly stable and reliable.

What is claimed is:

1. A deflection yoke device comprising a core, a vertical deflection coil and a horizontal deflection coil, in combination with an in-line type color picture tube; said vertical deflection coil having a winding distribution for producing a barrel type magnetic field distribution and said horizontal deflection coil having a whole winding distribution for producing a pincushion type magnetic field distribution sufficient to make the convergence of side electron beams over the entirety of a picture screen of said color picture tube and further having a first winding distribution, at the funnel side portion of the horizontal deflection coil, for producing a sharp pincushion type magnetic field distribution as well as a second winding distribution, at the neck side portion of the horizontal deflection coil, for producing a sharp barrel type magnetic field sufficient to permit the central electron beam to land outside the side electron beams converged with each other at the right and left sides of the picture screen.

* * * * *